US009843166B2

(12) United States Patent
Okazaki et al.

(10) Patent No.: US 9,843,166 B2
(45) Date of Patent: Dec. 12, 2017

(54) SPARK PLUG AND METHOD FOR MANUFACTURING SPARK PLUG

(71) Applicant: NGK Spark Plug Co., LTD., Nagoya (JP)

(72) Inventors: Koji Okazaki, Ichinomiya (JP); Kei Takahashi, Nagoya (JP); Kazuhiko Mori, Nisshin (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/839,022

(22) Filed: Aug. 28, 2015

(65) Prior Publication Data

US 2016/0079739 A1 Mar. 17, 2016

(30) Foreign Application Priority Data

Sep. 16, 2014 (JP) ..... 2014-187258

(51) Int. Cl.
*H01T 13/08* (2006.01)
*H01T 13/20* (2006.01)

(52) U.S. Cl.
CPC ..... *H01T 13/20* (2013.01); *H01T 13/08* (2013.01)

(58) Field of Classification Search
CPC ..... H01T 13/54; H01T 13/08; H01T 13/20
USPC ..... 313/118, 134, 139, 143, 148
See application file for complete search history.

(56) References Cited

U.S. PATENT DOCUMENTS

| | | | | |
|---|---|---|---|---|
| 4,465,031 | A | 8/1984 | Bamer et al. | |
| 8,138,660 | B2 * | 3/2012 | Nakamura | H01T 13/50 313/139 |
| 2012/0242215 | A1 | 9/2012 | Hwang et al. | |
| 2013/0008305 | A1 | 1/2013 | Yoshioka et al. | |

FOREIGN PATENT DOCUMENTS

| | | | |
|---|---|---|---|
| JP | 2011-214492 | A | 10/2011 |
| JP | 2011-231879 | A | 11/2011 |
| JP | 2012-199236 | A | 10/2012 |
| WO | WO-2012/113002 | A | 8/2012 |

OTHER PUBLICATIONS

Office Action dated Aug. 9, 2016 for the corresponding Japanese Patent Application No. 2014-187258.

* cited by examiner

*Primary Examiner* — Donald Raleigh
*Assistant Examiner* — Jacob R Stern
(74) *Attorney, Agent, or Firm* — Leason Ellis LLP

(57) ABSTRACT

A spark plug includes: a metallic shell having a through hole extending in a direction of an axis; a cap covering an opening in the metallic shell; a melt portion formed between the cap and the metallic shell to join the cap and the metallic shell to each other; and a gap extending from a specific space which is surrounded by the metallic shell and the cap to the melt portion and interposed between the metallic shell and the cap.

7 Claims, 8 Drawing Sheets

SPARK PLUG AND METHOD FOR MANUFACTURING SPARK PLUG

This application claims the benefit of Japanese Patent Applications No. 2014-187258, filed Sep. 16, 2014, which is incorporated by reference in its entity herein.

FIELD OF THE INVENTION

The present disclosure relates to a spark plug.

BACKGROUND OF THE INVENTION

Conventionally, a spark plug is used for ignition of an air-fuel mixture or the like within a combustion chamber of an internal combustion engine. As a spark plug, for example, a spark plug including a housing and a cap fixed to the housing by means of welding has been proposed. The cap includes a plurality of orifices. Flame jets out from the orifices, whereby a flame jet for ignition is generated around the cap.

PRIOR ART DOCUMENT

Patent Document

[Patent Document 1] Japanese Patent Application Laid-Open (kokai) No. 2012-199236

[Patent Document 2] Japanese Patent Application Laid-Open (kokai) No. 2011-214492

Problems to be Solved by the Invention

In the case of welding components of a spark plug (e.g., the case of welding a cap to a housing), a problem may occur due to the welding. For example, by gas such as air being trapped in a portion melted by the welding, a small void may be formed in the portion that has been cooled and solidified. Such a void can cause a problem such as cracking.

The present disclosure provides a technique to reduce a possibility of occurrence of a problem due to welding.

SUMMARY OF THE INVENTION

Means for Solving the Problems

According to modes of the present disclosure, for example, the following application examples are provided.

Application Example 1

A spark plug including:

a metallic shell having a through hole extending in a direction of an axis;

a cap covering that is located at a front side of the spark plug and covers an opening in the metallic shell;

a melt portion provided between the cap and the metallic shell, said melt portion joining the cap and the metallic shell to each other; and a gap extending from a specific space which is surrounded by the metallic shell and the cap to the melt portion and interposed between the metallic shell and the cap.

According to this configuration, at the time of formation of the melt portion, degassing can be performed through the gap, and thus a possibility of occurrence of a problem due to welding can be reduced.

Application Example 2

The spark plug described in the application example 1, wherein the gap includes:

a first gap which communicates with the specific space; and a second gap which communicates with the first gap and the specific space and is larger than the first gap.

According to this configuration, at the time of formation of the melt portion, degassing can be appropriately performed through the second gap larger than the first gap, and thus the possibility of occurrence of a problem due to welding can be reduced.

Application Example 3

The spark plug described in the application example 2, wherein the metallic shell has a first surface which is not perpendicular to the axis, and the cap has a second surface which faces the first surface of the metallic shell to provide the first gap and the second gap.

According to this configuration, the possibility of occurrence of a problem due to welding can be reduced while misalignment of the cap relative to the metallic shell (in particular, misalignment in a direction perpendicular to the axis) is suppressed.

Application Example 4

The spark plug described in the application example 3, wherein the first surface of the metallic shell is located at the front side and is a portion of an inner peripheral surface of the metallic shell, the cap includes a projection portion which projects toward a rear side of the spark plug and is located at an inner peripheral side of the first surface of the metallic shell, and the second surface of the cap is located at an outer peripheral side of the metallic shell and is a surface of the projection portion.

According to this configuration, the possibility of occurrence of a problem due to welding can be reduced while misalignment of the cap relative to the metallic shell (in particular, misalignment in the direction perpendicular to the axis) is suppressed.

Application Example 5

The spark plug described in any one of the application examples 1 to 4, wherein the gap is annular.

According to this configuration, degassing is possible from any position in the circumferential direction at the time of formation of the melt portion, and thus the possibility of occurrence of a problem due to welding can be reduced.

Application Example 6

The spark plug described in any one of the application examples 1 to 4, wherein the gap is provided at a plurality of positions in a circumferential direction when being seen from the direction of the axis.

According to this configuration, at the time of formation of the melt portion, degassing can be appropriately performed through the gap provided at the plurality of positions in the circumferential direction, and thus the possibility of occurrence of a problem due to welding can be reduced.

Application Example 7

The spark plug described in any one of the application examples 2 to 4, wherein the metallic shell and the cap form N second gaps whose positions in the circumferential direction are different from each other, N being an integer which is equal to or higher than 3, and when the N second gaps are projected parallel to the axis, onto a projection surface perpendicular to the axis, and the projection surface is divided into three regions each having a center angle of 120 degrees centered at the axis, each of the three regions includes one or more of the second gaps.

According to this configuration, uneven arrangement of the N second gaps in the circumferential direction is suppressed, and thus the possibility of occurrence of a problem due to welding can be appropriately reduced.

Application Example 8

A method for manufacturing a spark plug, the method comprising the steps of:

placing a cap at a specific position which covers an opening in a metallic shell located at a front side of the spark plug, said metallic shell having a through hole extending in a direction of an axis; and welding the cap placed at the specific position to the metallic shell, wherein the metallic shell and the cap placed at the specific position form an annular gap which communicates with a specific space surrounded by the metallic shell and the cap and is interposed between the metallic shell and the cap, the annular gap includes:

a first gap which communicates with the specific space; and a second gap which communicates with the specific space and is larger than the first gap, and the step of welding the cap to the metallic shell further comprises the sub-steps of:

welding a specific portion whose position in a circumferential direction is different from that of a specific second gap, of a boundary between the cap and the metallic shell which communicates with the annular gap; and after welding the specific portion, welding a portion whose position in the circumferential direction is the same as that of the specific second gap, of the boundary.

According to this configuration, degassing can be performed through the specific second gap portion when the specific portion is welded, and thus the possibility of occurrence of a problem in welding can be reduced.

The present invention can be embodied in various forms. For example, the present invention can be embodied in forms such as a spark plug, a method for manufacturing a spark plug, and a spark plug manufactured by the manufacturing method.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

A1. Device Configuration

Figure 1:
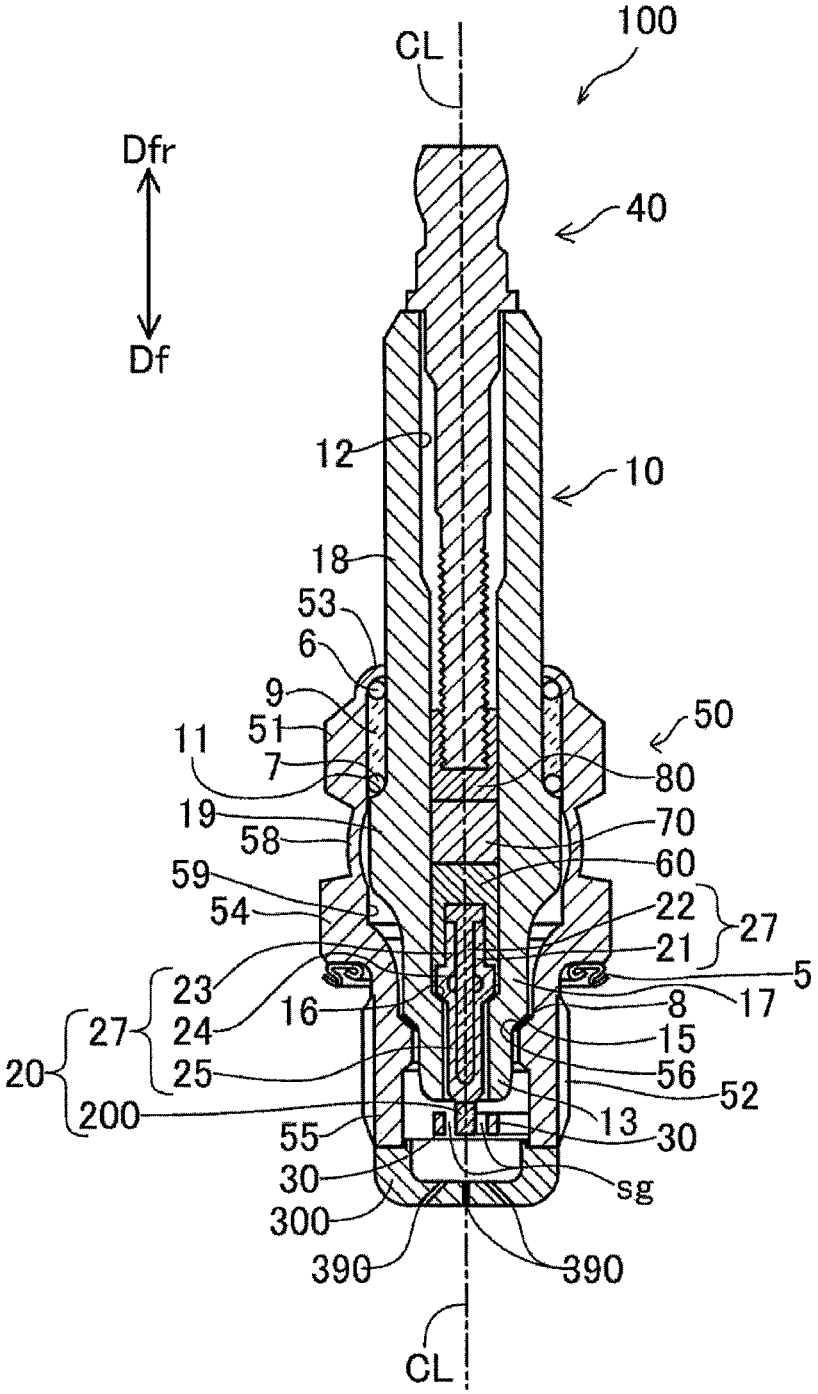
FIG. 1 is a cross-sectional view of an embodiment of a spark plug.

FIG. 1 is a cross-sectional view of an embodiment of a spark plug. In the drawing, the central axis CL (also referred to as "axis CL") of a spark plug 100 is shown. The cross section shown is a cross section including the central axis CL. Hereinafter, a direction parallel to the central axis CL is referred to as "direction of the axis CL" or merely as "axial direction". The radial direction of a circle centered on the central axis CL is referred to merely as "radial direction", and the circumferential direction of the circle centered on the central axis CL is referred to as "circumferential direction". In the direction parallel to the central axis CL, the downward direction in FIG. 1 is referred to as a front end direction Df, and the upward direction in FIG. 1 is referred to as a rear end direction Dfr. The front end direction Df is a direction from a metal terminal 40 described later toward electrodes 20 and 30 described later. In addition, the front end direction Df side in FIG. 1 is referred to as a front side of the spark plug 100, and the rear end direction Dfr side in FIG. 1 is referred to as a rear side of the spark plug 100.

The spark plug 100 includes an insulator 10 (also referred to as "ceramic insulator 10", the center electrode 20, the ground electrodes 30, the metal terminal 40, a metallic shell 50, a conductive first seal portion 60, a resistor 70, a conductive second seal portion 80, a front packing 8, a talc 9, a first rear packing 6, a second rear packing 7, and a cap 300.

The insulator 10 is a substantially cylindrical member having a through hole 12 (hereinafter, also referred to as "axial bore 12") which extends along the central axis CL to penetrate the insulator 10. The insulator 10 is formed by baking a material containing alumina (another insulating material may be used). The insulator 10 includes a leg portion 13, a first reduced outer diameter portion 15, a front trunk portion 17, a flange portion 19, a second reduced outer diameter portion 11, and a rear trunk portion 18 which are arranged in order from the front side toward the rear end direction Dfr. The flange portion 19 is a portion having a largest outer diameter in the insulator 10. The outer diameter of the first reduced outer diameter portion 15 gradually decreases from the rear side toward the front side. Near the first reduced outer diameter portion 15 of the insulator 10 (in the front trunk portion 17 of the embodiment in FIG. 1), a reduced inner diameter portion 16 is formed which has an inner diameter gradually decreasing from the rear side toward the front side. The outer diameter of the second reduced outer diameter portion 11 gradually decreases from the front side toward the rear side.

The center electrode 20 is inserted in the front side of the axial bore 12 of the insulator 10. The center electrode 20 includes a bar-shaped axial portion 27 extending along the central axis CL, and a tip 200 joined to the front end of the axial portion 27. The axial portion 27 includes a leg portion 25, a flange portion 24, and a head portion 23 which are arranged in order from the front side toward the rear end direction Dfr. The tip 200 is joined to the front end of the leg portion 25 (i.e., the front end of the axial portion 27) (e.g., by means of laser welding). The tip 200 is exposed outside from the axial bore 12 at the front side of the insulator 10. A surface, at the front end direction Df side, of the flange portion 24 is supported by the reduced inner diameter portion 16 of the insulator 10. In addition, the axial portion 27 also includes an outer layer 21 and a core portion 22. The outer layer 21 is formed of a material having more excellent oxidation resistance than that of the core portion 22, that is, a material which less wears when being exposed to a combustion gas within a combustion chamber of an internal combustion engine (e.g., pure nickel, an alloy containing nickel and chromium, etc.). The core portion 22 is formed of a material having a higher coefficient of thermal conductivity than that of the outer layer 21 (e.g., pure copper, a copper alloy, etc.). A rear end portion of the core portion 22 is exposed from the outer layer 21 to form a rear end portion of the center electrode 20. The other portion of the core portion 22 is covered with the outer layer 21. However, the entirety of the core portion 22 may be covered with the outer layer 21. In addition, the tip 200 is formed by using a material having more excellent durability against discharge than the axial portion 27 (e.g., noble metals such as iridium (Ir) and platinum (Pt), tungsten (W), and an alloy containing at least one metal selected from these metals).

A portion of the metal terminal 40 is inserted in the rear side of the axial bore 12 of the insulator 10. The metal terminal 40 is formed by using a conductive material (e.g., a metal such as low-carbon steel).

Within the axial bore 12 of the insulator 10, the resistor 70 which has a substantially columnar shape and serves to suppress electrical noise is disposed between the metal terminal 40 and the center electrode 20. The resistor 70 is formed by using, for example, a material containing a conductive material (e.g., carbon particles), ceramic particles (e.g., $ZrO_2$), and glass particles (e.g., $SiO_2$—$B_2O_3$—$Li_2O$—BaO-based glass particles). The conductive first seal portion 60 is disposed between the resistor 70 and the center electrode 20, and the conductive second seal portion 80 is disposed between the resistor 70 and the metal terminal 40. Each of the seal portions 60 and 80 is formed by using, for example, a material containing metal particles (e.g., Cu) and the same glass particles as those included in the material of the resistor 70. The center electrode 20 and the metal terminal 40 are electrically connected to each other via the resistor 70 and the seal portions 60 and 80.

The metallic shell 50 is a substantially cylindrical member having a through hole 59 which extends along the central axis CL to penetrate the metallic shell 50. The metallic shell 50 is formed by using a low-carbon steel material (another conductive material (e.g., a metal material) may be used). The insulator 10 is inserted in the through hole 59 of the metallic shell 50. The metallic shell 50 is fixed to the outer periphery of the insulator 10. At the rear side of the metallic shell 50, the rear end of the insulator 10 (in the present embodiment, a portion, at the rear side, of the rear trunk portion 18) is exposed outside from the through hole 59.

At the front side of the metallic shell 50, the front end of the center electrode 20 (here, the front end of the tip 200) is disposed within the through hole 59. Each bar-shaped ground electrode 30 is fixed to the inner peripheral surface of the metallic shell 50. Each ground electrode 30 extends from the inner peripheral surface of the metallic shell 50 to a position facing a side surface of the tip 200. Each ground electrode 30 and the side surface of the tip 200 form a gap sg. In the gap sg (hereinafter, referred to as "discharge gap sg"), spark discharge occurs. Each ground electrode 30 is formed by using a material having excellent oxidation resistance (e.g., an alloy containing nickel and chromium) (another material may be used). The cap 300 is fixed to the front side of the metallic shell 50 so as to cover an opening, at the front side, of the metallic shell 50. The cap 300 is formed by using a material having excellent oxidation resistance (e.g., an alloy containing nickel and chromium) (another material may be used). The center electrode 20, each ground electrode 30, and the cap 300 will be described in detail later.

The metallic shell 50 includes a trunk portion 55, a seat portion 54, a deformable portion 58, a tool engagement portion 51, and a crimp portion 53 which are arranged in order from the front side toward the rear side. The seat portion 54 is a flange-like portion. The trunk portion 55 is a substantially cylindrical portion extending from the seat portion 54 toward the front end direction Df along the central axis CL. The outer peripheral surface of the trunk portion 55 has a thread 52 formed thereon for screwing into a mount hole of an internal combustion engine. An annular gasket 5 which is formed by bending a metal plate is fitted between the seat portion 54 and the thread 52.

The metallic shell 50 includes a reduced inner diameter portion 56 disposed at the front end direction Df side of the deformable portion 58. The inner diameter of the reduced inner diameter portion 56 gradually decreases from the rear side toward the front side. The front packing 8 is interposed between the reduced inner diameter portion 56 of the metallic shell 50 and the first reduced outer diameter portion 15 of the insulator 10. The front packing 8 is an O-shaped ring made of iron (another material (e.g., a metal material such as copper) may be used). The front packing 8 seals between the metallic shell 50 and the insulator 10.

The tool engagement portion 51 is a portion for engaging with a tool for tightening the spark plug 100 (e.g., a spark plug wrench). In the present embodiment, the external shape of the tool engagement portion 51 is substantially a hexagonal column extending along the central axis CL. In addition, the crimp portion 53 is disposed at the rear side of the second reduced outer diameter portion 11 of the insulator 10 and forms the rear end of the metallic shell 50 (i.e., an end at the rear end direction Dfr side). The crimp portion 53 is bent inward in the radial direction. At the front end direction Df side of the crimp portion 53, the first rear packing 6, the talc 9, and the second rear packing 7 are arranged between the inner peripheral surface of the metallic shell 50 and the outer peripheral surface of the insulator 10 in this order toward the front end direction Df. In the present embodiment, the rear packings 6 and 7 are C-shaped rings made of iron (another material may be used).

In manufacturing of the spark plug 100, the crimp portion 53 is crimped so as to be bent inward. Then, the crimp portion 53 is pressed to the front end direction Df side. Accordingly, the deformable portion 58 deforms, and the insulator 10 is pressed toward the front side within the metallic shell 50 via the packings 6 and 7 and the talc 9. The front packing 8 is pressed between the first reduced outer diameter portion 15 and the reduced inner diameter portion 56 to seal between the metallic shell 50 and the insulator 10. In this manner, the insulator 10 is fixed to the metallic shell 50.

Figure 2:
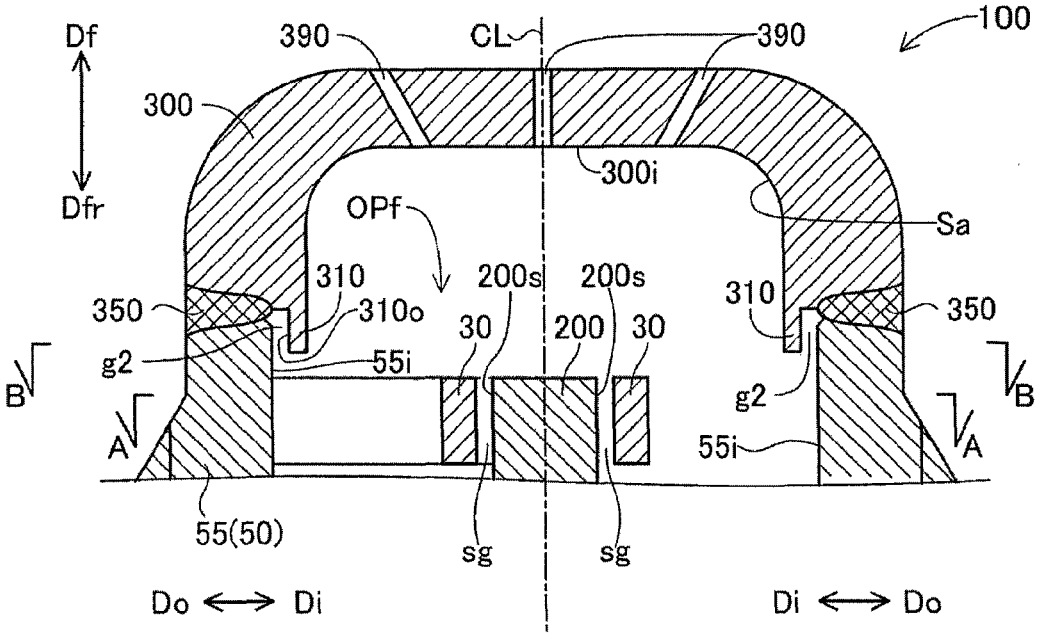
FIG. 2 is a cross-sectional view, of a front end portion of a spark plug 100, including a central axis CL.

Next, a portion, at the front end direction Df side, of the spark plug 100 will be described. FIG. 2 is a cross-sectional view, of a front end portion of the spark plug 100, including the central axis CL. In FIG. 2, the upward direction corresponds to the front end direction Df, and the downward direction corresponds to the rear end direction Dfr. In the drawing, a front end portion of the metallic shell 50 (here, a front end portion of the trunk portion 55), a front end portion of the tip 200, the ground electrodes 30, and the cap 300 are shown. An inward direction Di shown in the lower portion in the drawing is a direction toward the inner side in the radial direction, and an outward direction Do shown in the lower portion in the drawing is a direction toward the outer side in the radial direction.

Figure 3:
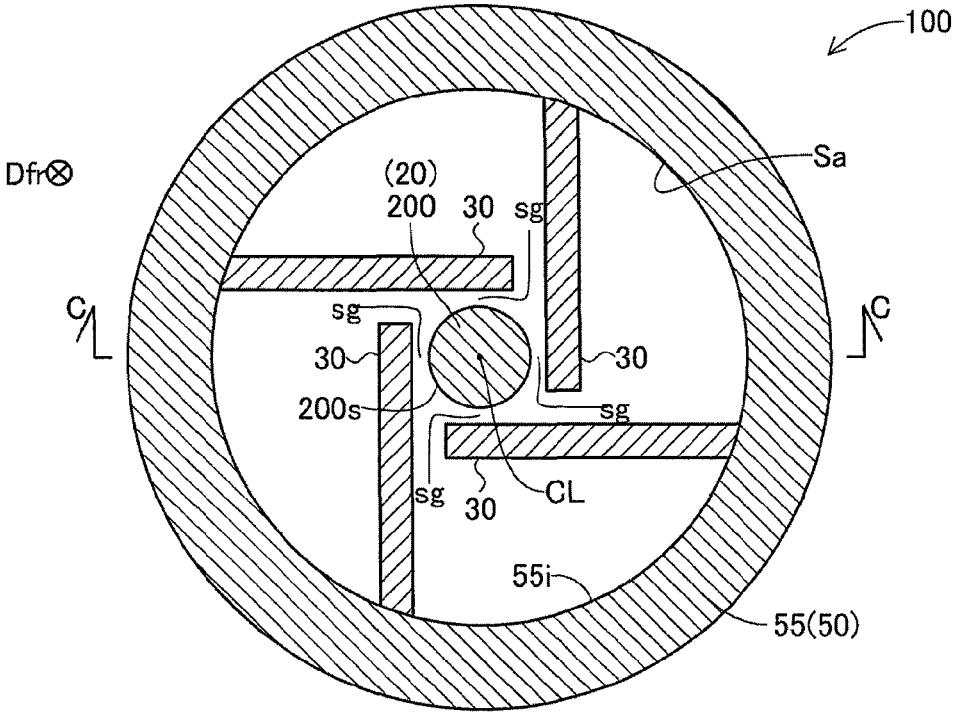
FIG. 3 is a cross-sectional view, of the front end portion of the spark plug 100, perpendicular to the central axis CL.
Figure 4:
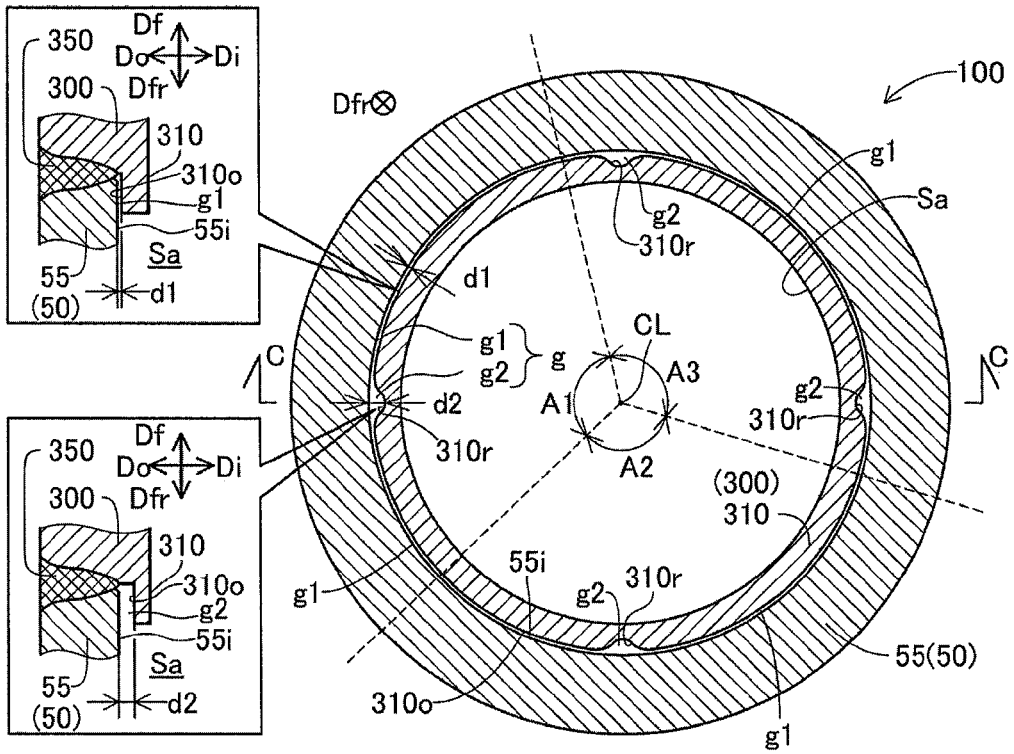
FIG. 4 is a cross-sectional view, of the front end portion of the spark plug 100, perpendicular to the central axis CL.

FIG. 3 is a cross-sectional view, of the front end portion of the spark plug 100, perpendicular to the central axis CL. The cross-sectional view shows a cross section taken along a line A-A in FIG. 2. In the drawing, the tip 200 of the center electrode 20, the ground electrodes 30, and the trunk portion 55 of the metallic shell 50 are shown. FIG. 4 is a cross-sectional view, of the front end portion of the spark plug 100, perpendicular to the central axis CL. This cross-sectional view shows a cross section taken along a line B-B in FIG. 2, which is a cross section at the front end direction Df side of the cross section (A-A cross section) in FIG. 3. In the drawing, the trunk portion 55 of the metallic shell 50 and a later-described projection portion 310 of the cap 300 are shown. The cross-sectional view in FIG. 2 shows a cross section taken along a line C-C in FIGS. 3 and 4.

As shown in FIGS. 2 and 3, in the present embodiment, each ground electrode 30 is a bar-shaped electrode having a rectangular cross section. One end portion of each ground electrode 30 is joined to an inner peripheral surface 55*i* of the trunk portion 55 (e.g., by means of laser welding). The other end portion of each ground electrode 30 faces the side surface 200*s* of the tip 200 across the discharge gap sg. In the present embodiment, four ground electrodes 30 are disposed at substantially equal intervals in the circumferential direction. The side surface 200*s* of the tip 200 is surrounded by the four ground electrodes 30.

As shown in FIG. 2, the cap 300 is a member which covers an opening OPf, at the front end direction Df side, of the metallic shell 50. In the present embodiment, the cross-sectional shape of the cap 300 is a substantially U shape which projects to the front end direction Df side. The shape of the cap 300 is a cup shape obtained by rotating this cross-sectional shape about the central axis CL.

The cap 300 is welded to the front end portion of the metallic shell 50 (here, the trunk portion 55). A melt portion 350 is formed between the cap 300 and the metallic shell 50. The melt portion 350 is formed by a portion of the cap 300 and a portion of the trunk portion 55 which are melted at the time of welding. The melt portion 350 joins the trunk portion 55 and the cap 300 to each other. Specifically, the melt portion 350 joins an annular end portion, at the rear end direction Dfr side, of the cap 300 and an annular end portion, at the front end direction Df side, of the metallic shell 50 to each other.

The cap 300 and the metallic shell 50 form a space Sa (referred to as "specific space Sa") surrounded by a surface 300*i* at the inner side (referred to as "inner surface 300*i*") of the cap 300 and the inner peripheral surface 55*i* of the metallic shell 50 (here, the trunk portion 55). The discharge gap sg (that is, the tip 200 of the center electrode 20 and the ground electrodes 30) is located within the specific space Sa. The cap 300 has a plurality of holes 390 formed so as to provide communication between the inner side (i.e., the specific space Sa side) and the outer side of the cap 300. Although not shown in detail, in the present embodiment, the cap 300 has one hole 390 provided on the central axis CL and four holes 390 located around the central axis CL.

As shown in FIG. 2, the cap 300 includes the projection portion 310 which projects at the inner peripheral side near a joined portion of the cap 300 and the trunk portion 55 toward the rear end direction Dfr side. The projection portion 310 is disposed at the inner peripheral side of the front end portion of the trunk portion 55. A gap g2 is formed between the inner peripheral surface 55*i* of the trunk portion 55 and an outer peripheral surface 310*o* of the projection portion 310. The gap g2 extends from the specific space Sa to the melt portion 350.

FIG. 4 shows a cross section of the projection portion 310. In the cross section in FIG. 4, the shape of the inner peripheral surface 55*i* of the trunk portion 55 is a substantially circular shape. The projection portion 310 is an annular portion disposed at the inner peripheral side of the inner peripheral surface 55*i* of the trunk portion 55. An annular gap g is formed between the outer peripheral surface 310*o* of the projection portion 310 and the inner peripheral surface 55*i* of the trunk portion 55. The projection portion 310 has a plurality of (here, four) recesses 310*r* formed as portions obtained by recessing the outer peripheral surface 310*o* toward the inner peripheral side. The plurality of recesses 310*r* are located at substantially equal intervals along the circumferential direction. The gap g includes second gaps g2 formed by the recesses 310*r* and first gaps g1 formed by the other portion of the outer peripheral surface 310*o*.

The left portion of FIG. 4 shows a partial cross section including the first gap g1 and a partial cross section including the second gap g2. These partial cross sections are cross sections including the central axis CL, similarly to the cross section in FIG. 2. Of the inner peripheral surface 55*i* of the metallic shell 50, the portion forming the gaps g1 and g2 is the inner peripheral surface of a portion, at the front end direction Df side, of the inner peripheral surface 55*i*, and is parallel to the central axis CL. The outer peripheral surface 310*o* of the projection portion 310 faces the inner peripheral surface 55*i* to form the gaps g1 and g2.

Each first gap g1 communicates with the specific space Sa and extends from the specific space Sa to the melt portion 350. Each second gap g2 communicates with both the first gaps g1 and the specific space Sa and extends from the specific space Sa to the melt portion 350. In addition, each second gap g2 is larger than each first gap g1. In particular, a size d2, in the radial direction, of each second gap g2 is larger than a size d1, in the radial direction, of each first gap g1. The reason why the gaps g1 and g2 having different sizes are formed as described above will be described later.

An operation of the spark plug 100 described above will be described. The spark plug 100 is mounted to an internal combustion engine such as a gas engine when being used. A voltage is applied between the ground electrodes 30 and the center electrode 20 of the spark plug 100 by an igniter (e.g., a full-transistor igniter). As a result, spark discharge occurs in the discharge gap sg formed by each ground electrode 30 and the center electrode 20. The spark discharge occurs within the specific space Sa. Meanwhile, an air-fuel mixture within a combustion chamber of the internal combustion engine is introduced through the holes 390 of the cap 300 into the specific space Sa. The air-fuel mixture within the specific space Sa is ignited by spark caused within the specific space Sa. Flame generated by combustion of the ignited air-fuel mixture jets out through the holes 390 of the cap 300 to the outside (i.e., the combustion chamber). The air-fuel mixture within the combustion chamber is ignited by the flame having jetted out. As a result, in particular, even in the case of an internal combustion engine including a combustion chamber having a relatively large volume, the entire air-fuel mixture within the combustion chamber can be rapidly combusted. As the configuration of the holes 390 of the cap 300 (e.g., the total number, the arrangement, and the inner diameters thereof), various configurations different from the configuration described with reference to FIG. 2 can be used. In general, the configuration of the holes 390 may be experimentally determined such that an appropriate jet of flame is achieved.

A2. Manufacturing Method

Figure 5:
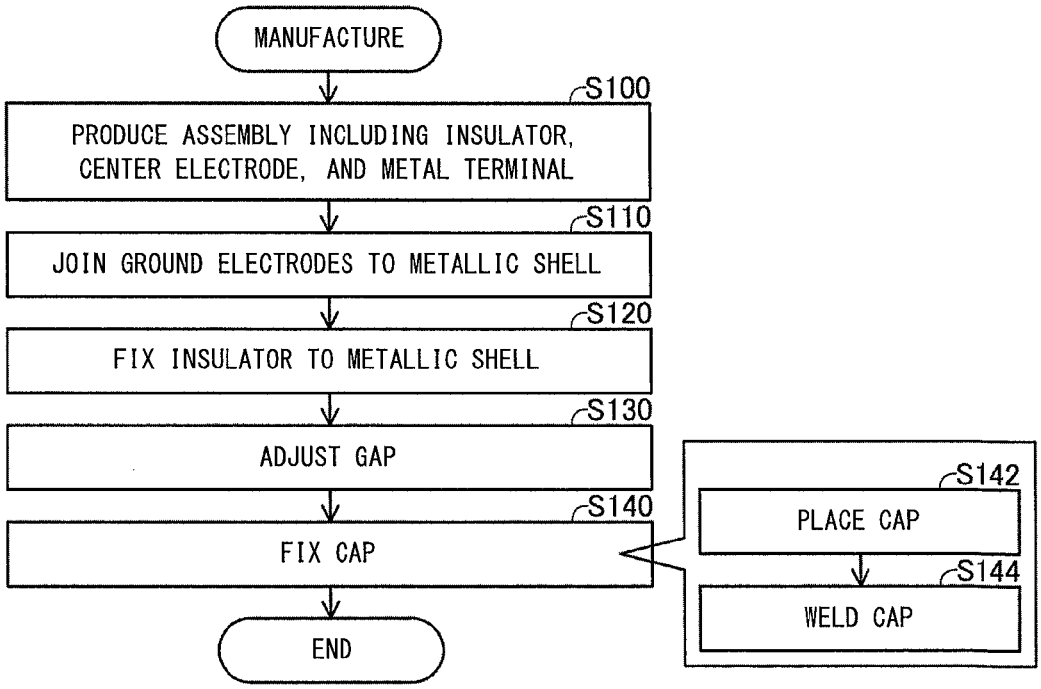
FIG. 5 is a flowchart showing an example of a method for manufacturing the spark plug 100.

FIG. 5 is a flowchart showing an example of a method for manufacturing the spark plug 100. It is assumed that components of the spark plug 100 such as the metal terminal 40, the metallic shell 50, and the cap 300 have been already produced. The cap 300 can be produced, for example, by means of pressing.

In step S100, an assembly including the insulator 10, the center electrode 20, and the metal terminal 40 is produced. As a method for producing the assembly, a publicly known method can be used. For example, the center electrode 20, the material of the first seal portion 60, the material of the resistor 70, and the material of the second seal portion 80 are inserted into the through hole 12 of the insulator 10 in this order. Then, in a state where the insulator 10 is heated, the metal terminal 40 is inserted into the through hole 12, to produce the assembly.

In step S110, the ground electrodes 30 is joined to the inner peripheral surface 55*i* of the metallic shell 50. Steps S100 and S110 can proceed independently of each other.

In step S120, the assembly is fixed to the metallic shell 50. Specifically, the front packing 8, the assembly in step S100, the second rear packing 7, the talc 9, and the first rear packing 6 are placed into the through hole 59 of the metallic shell 50, and the crimp portion 53 of the metallic shell 50 is crimped so as to be bent inward, whereby the insulator 10 is fixed to the metallic shell 50.

In step S130, the distance of the discharge gap sg is adjusted. For example, a gauge having a predetermined thickness is inserted into the discharge gap sg, and each ground electrode 30 is bent such that the distance of the discharge gap sg is equal to the thickness of the gauge.

In step S140, the cap 300 is fixed to the front end portion of the metallic shell 50. First, the cap 300 is placed at a specific position covering the opening, at the front end direction Df side, of the metallic shell 50 (S142). Then, the cap 300 placed at the specific position is welded to the metallic shell 50 (S144). Through the above, the spark plug 100 is completed.

Figure 6A:
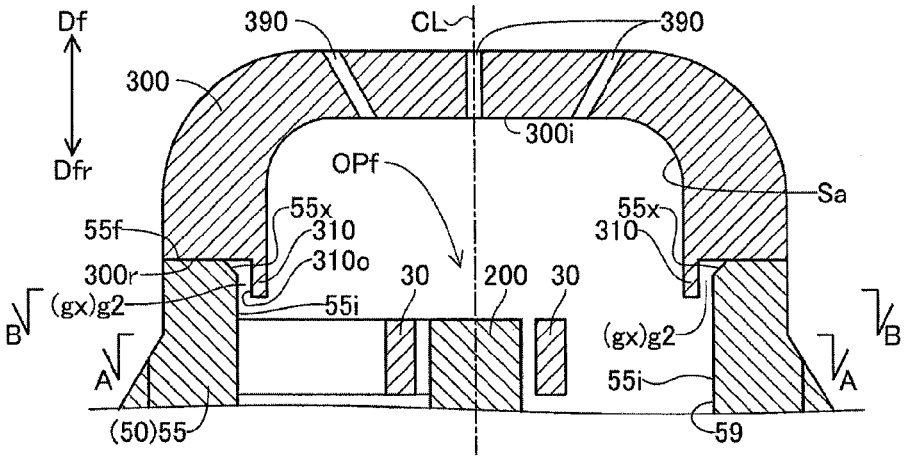
FIGS. 6(A) to 6(C) are cross-sectional views showing an arrangement of a cap 300 with respect to a metallic shell 50.
Figure 6B:
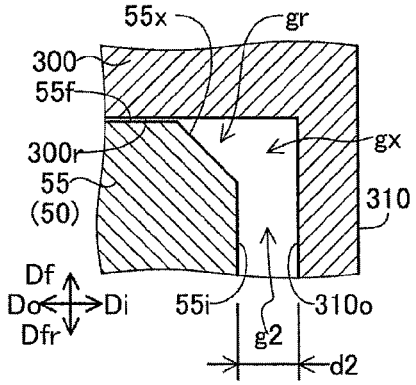
Figure 6C:
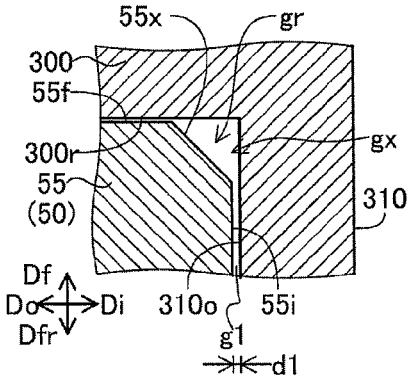

FIGS. 6(A) to 6(C) are cross-sectional views showing an arrangement of the cap 300 with respect to the metallic shell 50 in step S142 in FIG. 5. FIG. 6(A) shows a cross section of the entirety of the cap 300 and a portion, at the front end direction Df side, of the metallic shell 50, FIG. 6(B) shows a cross section around the second gap g2, and FIG. 6(C) shows a cross section around the first gap g1. These cross sections are cross sections including the central axis CL similarly to the cross section in FIG. 2.

The metallic shell 50 before welding has an end surface 55*f* at the front end direction Df side. The end surface 55*f* is an annular surface which extends around the central axis CL. In the present embodiment, the end surface 55*f* is a flat surface substantially perpendicular to the central axis CL. At a corner connecting the end surface 55*f* and the inner peripheral surface 55*i* (i.e., a corner, at the inner peripheral side, of an end portion, at the front end direction Df side, of the metallic shell 50), a chamfered portion 55*x* is formed such that the inner diameter thereof gradually decreases toward the rear end direction Dfr. The chamfered portion 55*x* is formed over the entire circumference of the corner, at the inner peripheral side, of the metallic shell 50.

The cap 300 before welding has an end surface 300*r* at the rear end direction Dfr side. The projection portion 310 is connected to the inner peripheral side of the end surface 300*r*, and projects in the rear end direction Dfr from the end surface 300*r*. The end surface 300*r* is an annular surface which extends around the central axis CL. In the present embodiment, the end surface 300*r* is a flat surface substantially perpendicular to the central axis CL. The outer diameter of the end surface 300*r* is substantially equal to the outer diameter of the end surface 55*f* of the metallic shell 50.

As shown in FIG. 6(A), in step S142, the projection portion 310 of the cap 300 is inserted into the through hole 59 through the opening OPf, at the front end direction Df side, of the metallic shell 50. Accordingly, the projection portion 310 is located within the through hole 59 of the metallic shell 50. The end surface 300*r* of the cap 300 is in contact with the end surface 55*f* of the metallic shell 50. The cap 300 covers the opening OPf, at the front end direction Df side, of the metallic shell 50. At this position, the cap 300 is welded to the metallic shell 50. Hereinafter, the position at which the cap 300 is welded to the metallic shell 50 is referred to as "specific position".

As shown in FIGS. 6(B) and 6(C), a gap gr is formed between the chamfered portion 55*x* of the metallic shell 50 and the cap 300. The gap gr communicates with the gap g (the first gaps g1 and the second gaps g2).

The metallic shell 50 and the cap 300 disposed at the specific position form an annular gap gx which communicates with the specific space Sa surrounded by the metallic shell 50 and the cap 300 and is interposed between the metallic shell 50 and the cap 300. The gap gx includes the gap g (i.e., the gaps g1 and g2) described with reference to FIG. 4 and the gap gr described with reference to FIGS. 6(B) and 6(C).

Since the chamfered portion 55*x* is formed at an end portion, at the front end direction Df side, of the inner peripheral surface of the metallic shell 50, insertion of the projection portion 310 is easy. Therefore, the size d1 of each first gap g1 can be reduced. By reducing the size d1, misalignment of the cap 300 relative to the metallic shell 50 (in particular, misalignment in a direction perpendicular to the central axis CL) can be decreased.

Figure 7:
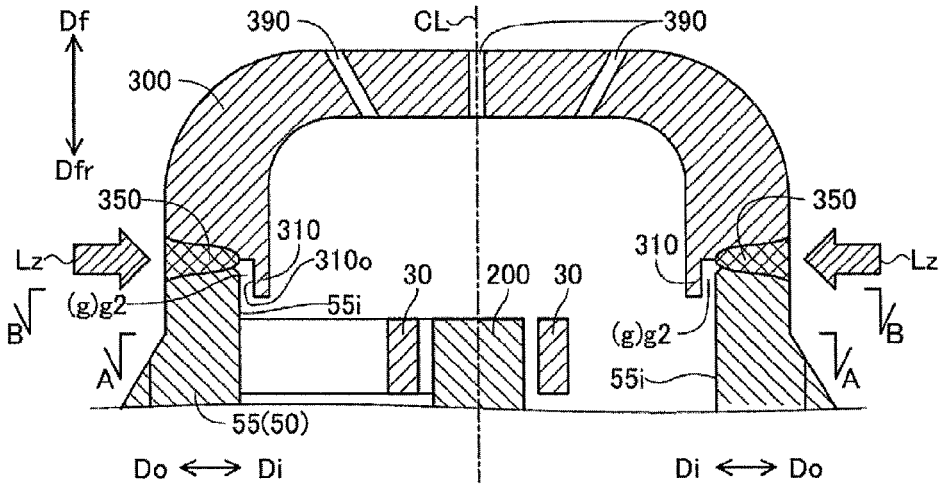
FIG. 7 is a schematic cross-sectional view in welding.

FIG. 7 is a schematic cross-sectional view in the welding in step S144 in FIG. 5. In the drawing, the same cross-sectional view as in FIG. 6(A) is shown. In the drawing, arrows Lz denote a laser beam. In the present embodiment, the laser beam Lz is applied to the outer peripheral side of a boundary portion between the metallic shell 50 and the cap 300, in a direction which is perpendicular to the central axis CL and toward the inner side in the radial direction. Accordingly, a portion, forming the end surface 55*f*, of the metallic shell 50 and a portion, forming the end surface 300*r*, of the cap 300 are melted, thereby forming the melt portion 350 which joins the metallic shell 50 and the cap 300 to each other. The melt portion 350 is formed so as to extend from the outer peripheral side to the inner peripheral side.

Figure 8A:
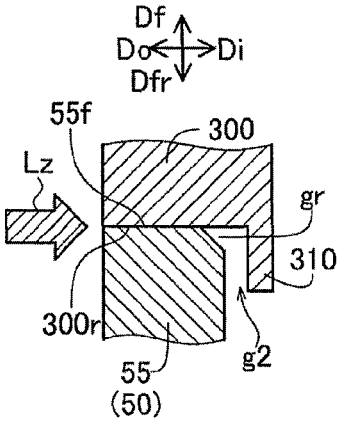
FIGS. 8(A) to 8(C) are schematic cross-sectional views showing a situation in which the welding proceeds.
Figure 8B:
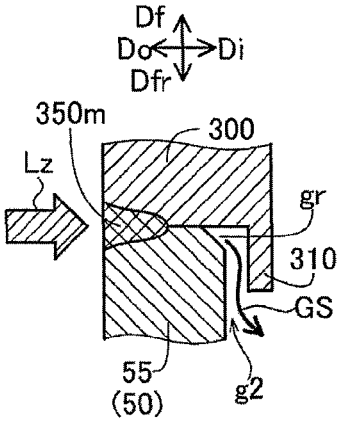
Figure 8C:
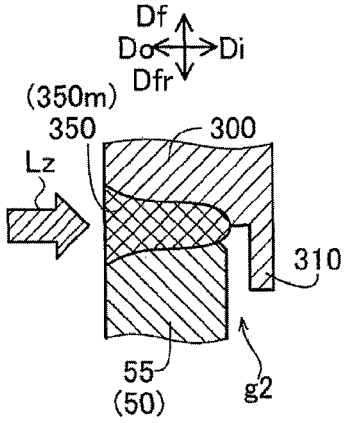
Figure 9A:
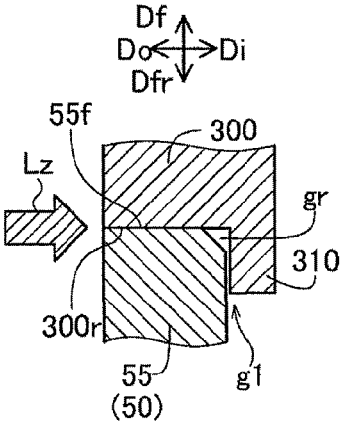
FIGS. 9(A) to 9(C) are schematic cross-sectional views showing the situation in which the welding proceeds.
Figure 9B:
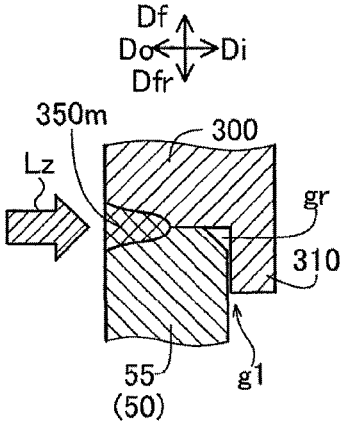
Figure 9C:
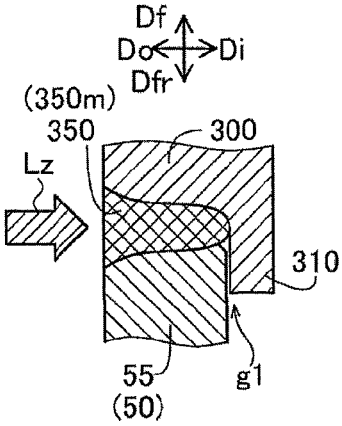

FIGS. 8(A) to 8(C) and 9(A) to 9(C) are schematic cross-sectional views showing a situation in which the welding proceeds. FIGS. 8(A) to 8(C) show a region around the second gap g2, and FIGS. 9(A) to 9(C) show a region around the first gap g1. Each cross-sectional view is a cross section including the central axis CL, similarly to the cross sections in FIGS. 6(A) to 6(C).

Around the second gap g2, the welding proceeds in order of FIG. 8(A), FIG. 8(B), and FIG. 8(C). By the application of the laser beam Lz, the cap 300 and the metallic shell 50 are melted. As the welding proceeds, a melted portion 350*m* extends in the inward direction Di from the outer peripheral surfaces of the cap 300 and the metallic shell 50 to the gap gr. Then, as a result of end of the application of the laser beam Lz, the melted portion 350*m* is cooled and solidified to form the melt portion 350. At the time of formation of the melt portion 350 (i.e., at the time of welding), gas GS (e.g., air) present between the end surfaces 55*f* and 300*r* and within the gap gr is exhausted out through the second gap g2.

Around the first gap g1, the welding proceeds in order of FIG. 9(A), FIG. 9(B), and FIG. 9(C). Similarly to FIGS. 8(A) to 8(C), as the welding proceeds, a melted portion 350*m* extends in the inward direction Di from the outer peripheral surfaces of the cap 300 and the metallic shell 50 to the gap gr. Then, as a result of end of the application of the laser beam Lz, the melted portion 350*m* is cooled and solidified to form the melt portion 350. At the time of formation of the melt portion 350, gas (e.g., air) present between the end surfaces 55*f* and 300*r* and within the gap gr can be exhausted out through the first gap g1. In addition, the gas can move through the gap gr to the second gap g2 at an un-welded position in the circumferential direction and can be exhausted out through the second gap g2.

As shown in FIGS. 8(A) to 8(C) and 9(A) to 9(C), in the present embodiment, the entirety of the end surface 55*f* of the metallic shell 50 is welded. That is, the entirety of a portion between the outer peripheral surface and the inner peripheral surface 55*i* of the front end portion of the metallic shell 50 is welded. Therefore, the strength of joining can be enhanced as compared to the case where only a part of the portion is welded.

Figure 10:
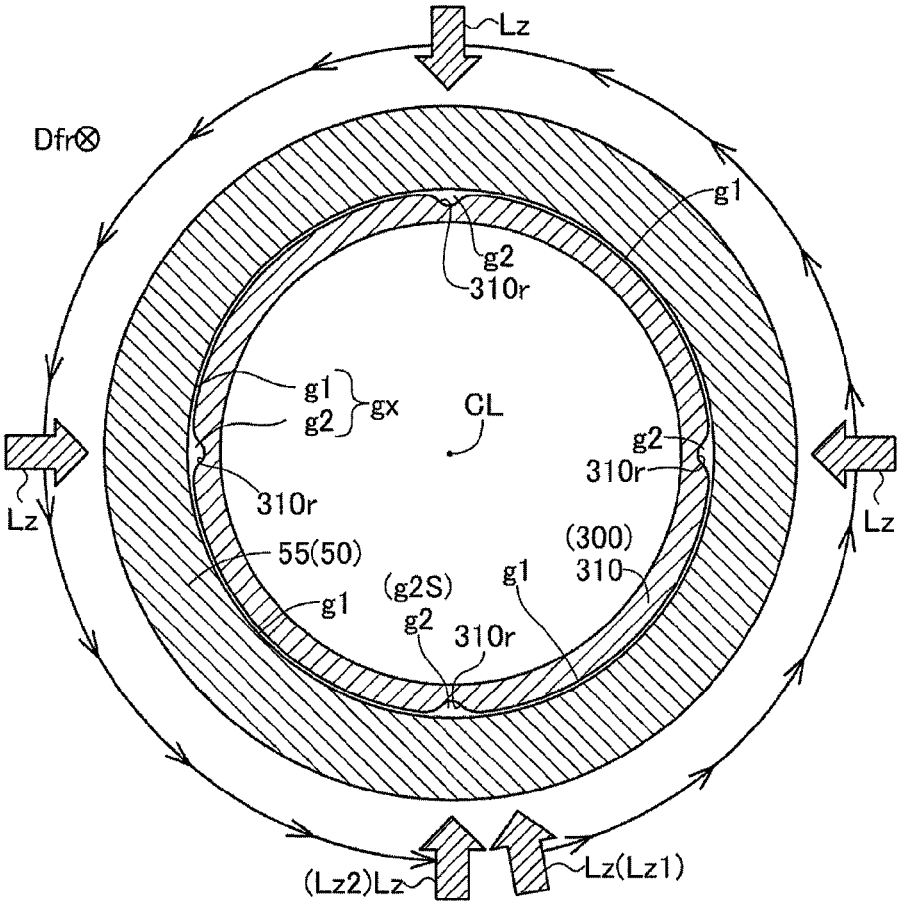
FIG. 10 is a schematic diagram showing an order of the welding.

FIG. 10 is a schematic diagram showing an order of the welding. In the drawing, the same cross section as in FIG. 4 is shown. The positions of arrows which denote the laser beam Lz in the drawing indicate positions of the laser beam Lz in the circumferential direction. In the method in FIG. 10, the laser beam Lz moves from a first position Lz1 as a specific position counterclockwise around the cap 300 and the metallic shell 50. Accordingly, the boundary portion between the cap 300 and the metallic shell 50 is welded over the entire circumference thereof.

The first position Lz1 is a position slightly shifted from the position, in the circumferential direction, of one second gap g2 (referred to as "specific second gap g2S") in the moving direction of the laser beam Lz (here, in the counterclockwise direction). At the first position Lz1, the laser beam Lz does not form the melt portion 350 in the cross section (FIGS. 8(A) to 8(C)) including the specific second gap g2S, and forms the melt portion 350 in the cross section (FIGS. 9(A) to 9(C)) including the first gap g1 adjacent to the specific second gap g2S.

In the drawing, a second position Lz2 indicates the position, in the circumferential direction, of a portion to be welded lastly. The second position Lz2 coincides with the position of the specific second gap g2S in the circumferential direction. The laser beam Lz which moves around in the circumferential direction as described above lastly forms the melt portion 350 in the cross section (FIGS. 8(A) to 8(C)) including the specific second gap g2S.

During welding at the same position in the circumferential direction as that of the first gap g1, gas is exhausted out via the gap gr through the second gap g2 at an un-welded position in the circumferential direction (e.g., the specific second gap g2S). Then, welding at the same position in the circumferential direction as that of the specific second gap g2S is performed lastly. Therefore, regardless of a position in the circumferential direction where welding is performed, degassing can be appropriately performed at least through the specific second gap g2S.

Figure 11A:
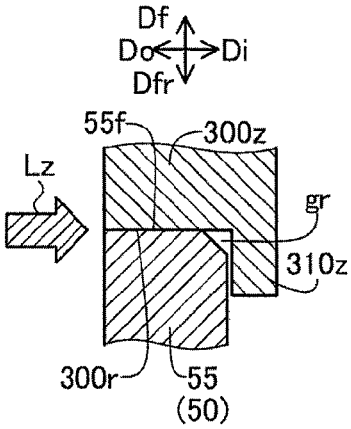
FIGS. 11(A) to 11(C) are schematic cross-sectional views showing a situation in which welding in a reference example proceeds.
Figure 11B:
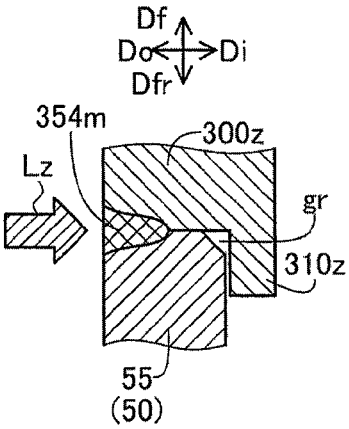
Figure 11C:
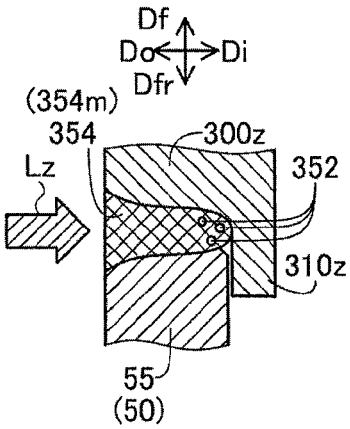

FIGS. 11(A) to 11(C) are schematic cross-sectional views showing a situation in which welding of a cap 300*z* and a metallic shell 50 in a reference example proceeds. The difference from the cap 300 of the embodiment in FIGS. 8(A) to 8(C) and 9(A) to 9(C) is only that the recesses 310*r* are omitted in a projection portion 310*z*. In the case of using the cap 300*z* of the reference example, the second gaps g2 are omitted, and an annular first gap g1 is formed (not shown). The configuration of the other portion of the cap 300*z* of the reference example is the same as that of the portion corresponding to the cap 300 of the embodiment. Of the elements of the cap 300*z*, the same elements as those of the cap 300 are designated by the same reference numerals, and the description thereof is omitted. The metallic shell 50 is the same as the metallic shell 50 of the embodiment.

The welding proceeds in order of FIG. 11(A), FIG. 11(B), and FIG. 11(C). By application of a laser beam Lz, the cap 300*z* and the metallic shell 50 are melted. As the welding proceeds, a melted portion 354*m* extends in the inward direction Di from the outer peripheral surfaces of the cap 300*z* and the metallic shell 50 to a gap gr. Then, as a result of end of the application of the laser beam Lz, the melted portion 354*m* is cooled and solidified to form a melt portion 354.

In the reference example, the large second gaps g2 are not formed, and thus gas present within the gap gr may not be able to be sufficiently exhausted out. The gas that has not been exhausted out and has remained can be trapped in the melted portion 354*m* to form voids 352 within the melt portion 354. Such voids 352 can cause cracking. Then, due to the voids 352, the strength of joining can decrease.

In the present embodiment, since degassing can be appropriately performed through the specific second gap g2S at the time of welding as described above, a possibility can be reduced that the voids 352 are formed in the melt portion 350. Therefore, a decrease in the strength of joining can be suppressed.

B. Second Embodiment

Figure 12:
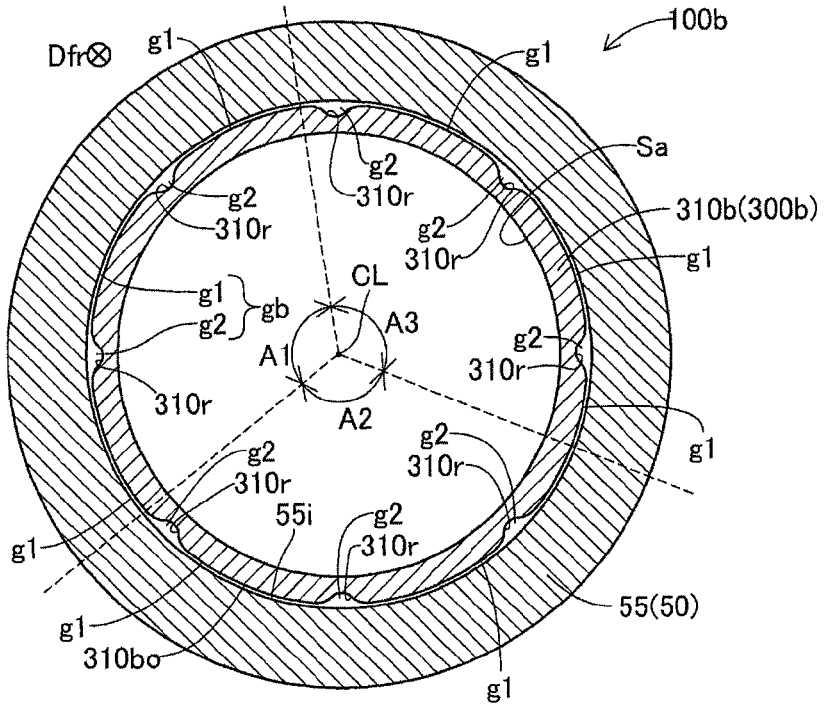
FIG. 12 is a cross-sectional view of a spark plug 100*b* of a second embodiment.

FIG. 12 is a cross-sectional view of a spark plug 100*b* of a second embodiment. In the drawing, the configuration in the same cross section as in FIG. 4 is shown. The difference from the spark plug 100 in FIG. 4 is only that the total number of recesses 310*r* provided in a projection portion 310*b* of a cap 300*b* is eight. The eight recesses 310*r* are located at substantially equal intervals along the circumferential direction. An annular gap gb is formed between an outer peripheral surface 310*bo* of the projection portion 310*b* and the inner peripheral surface 55*i* of the metallic shell 50. The gap gb includes first gaps g1 and second gaps g2. A method for welding the cap 300*b* and the metallic shell 50 is the same as the method described with reference to FIGS. 6(A) to 10. In the second embodiment, since the total number of the recesses 310*r*, that is, the total number of the second gaps g2, is large, degassing can be appropriately performed at the time of welding. Therefore, a decrease in the strength of joining can be suppressed. The configuration of the other portion of the spark plug 100*b* is the same as that of the portion corresponding to the spark plug 100 of the first embodiment (the same elements as the corresponding elements are designated by the same reference numerals, and the description thereof is omitted). In addition, the spark plug 100*b* can be manufactured by the manufacturing method in FIG. 5.

C. Third Embodiment

Figure 13:
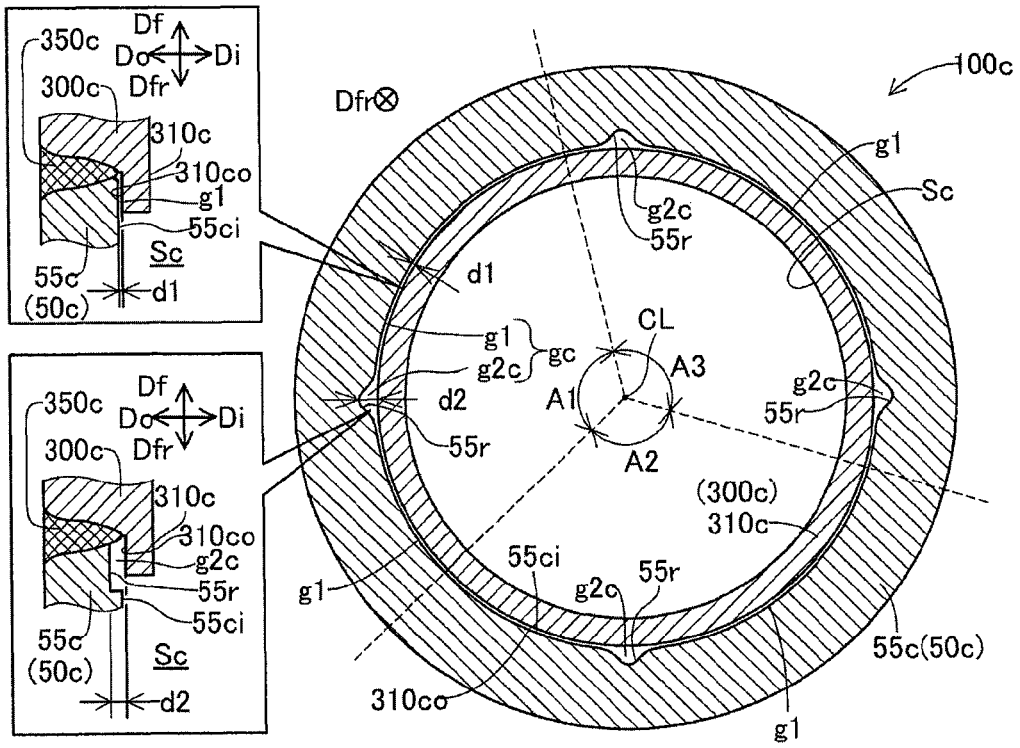
FIG. 13 is a cross-sectional view of a spark plug 100*c* of a third embodiment.

FIG. 13 is a cross-sectional view of a spark plug 100*c* of a third embodiment. In the drawing, the configuration in the same cross section as in FIG. 4 is shown. The difference from the spark plug 100 in FIG. 4 is only that the recesses 310*r* are omitted in a projection portion 310*c* of a cap 300*c*, and instead, a plurality of (here, four) recesses 55*r* are formed in a portion, at the front side, of a trunk portion 55*c* of a metallic shell 50*c* as portions obtained by recessing an inner peripheral surface 55*ci* toward the outward direction Do. Such recesses 55*r* can be formed, for example, by means of cutting. The shape of an outer peripheral surface 310*co* of the projection portion 310*c* is a cylindrical shape about the central axis CL. The configuration of the other portion of the spark plug 100*c* is the same as that of the portion corresponding to the spark plug 100 (the same elements as the corresponding elements are designated by the same reference numerals, and the description thereof is omitted). In addition, the spark plug 100*c* can be manufactured by the manufacturing method in FIG. 5.

As shown, an annular gap gc is formed between the outer peripheral surface 310*co* of the projection portion 310*c* of the cap 300*c* and the inner peripheral surface 55*ci* of the metallic shell 50*c* (here, the trunk portion 55*c*). The gap gc includes second gaps g2*c* formed by the recesses 55*r* and first gaps g1 formed by the other portion of the inner peripheral surface 55*ci*.

The cap 300*c* and the metallic shell 50*c* form a space Sc (referred to as "specific space Sc") surrounded by the inner peripheral surface 55*ci* of the metallic shell 50*c* and a surface at the inner side of the cap 300*c* which surface is not shown. Although not shown, a discharge gap sg is located within the specific space Sc.

The left portion of FIG. 13 shows a partial cross section including the first gap g1 and a partial cross section including the second gap g2*c*. These partial cross sections are cross sections including the central axis CL, similarly to the cross section in FIG. 2. The configuration in the cross section including the first gap g1 is the same as that in the cross section including the first gap g1 as shown in FIG. 4.

In the partial cross section including the second gap g2*c*, the recess 55*r* is shown. As shown, the recess 55*r* extends from a position at the rear end direction Dfr side of the projection portion 310*c* toward the front end direction Df side. The second gap g2*c* communicates with the first gaps g1 and the specific space Sc. The second gap g2*c* extends from the specific space Sc to a melt portion 350*c*. A method for welding the cap 300*c* and the metallic shell 50*c* is the same as the method described with reference to FIGS. 6(A) to 10. At the time of welding, degassing can be easily performed through the second gaps g2*c*.

D. Modified Embodiments (1) As the method for welding the cap to the metallic shell, other various methods can be used instead of the method described with reference to FIG. 10. For example, after welding in the entire range of the positions of the first gaps g1 in the circumferential direction is completed, welding may be performed at the positions of the second gaps g2 or g2*c* in the circumferential direction. In addition, welding at a plurality of positions in the circumferential direction may proceed in parallel. In either case, after welding at the positions, in the circumferential direction, of the first gaps g1 which communicate with the second gaps g2 or g2*c*, welding is preferably performed at the positions of second gaps g2 or g2*c* in the circumferential direction. By so doing, degassing can be appropriately performed through the second gaps g2 or g2*c* at the time of welding.

In general, as a method for fixing the cap and the metallic shell, the following method is preferably used. The cap is placed at a specific position with respect to the metallic shell (FIG. 5: S142). The specific position is a position at which the cap covers the opening, at the front side, of the metallic shell, and is a position at which the cap is welded to the metallic shell. The metallic shell and the cap placed at the specific position form a specific space which is a space surrounded by the metallic shell and the cap (e.g., the specific space Sa (FIG. 4) or the specific space Sc (FIG. 13)). In addition, the metallic shell and the cap placed at the specific position form an annular gap which communicates with the specific space and is interposed between the metallic shell and the cap (e.g., the gap gx (FIGS. 6(A) to 6(C), FIG. 10)). The annular gap includes a first gap which communicates with the specific space, and a second gap which communicates with the specific space and is larger than the first gap (e.g., the first gaps g1 and the second gaps g2 (FIG. 10)).

Then, the cap is welded to the metallic shell (FIG. 5: S144). In this welding, the boundary between the cap and the metallic shell which communicates with the annular gap is welded (e.g., a portion including the end surfaces 55*f* and 300*r* (FIGS. 8(A) to 8(C) and 9(A) to 9(C))). Here, of the boundary between the metallic shell and the cap, a specific portion which is a portion whose position in the circumferential direction is different from the position, in the circumferential direction, of the specific second gap is welded. For example, in the example in FIG. 10, the position, in the circumferential direction, of the specific portion is a remaining portion obtained by excluding the position, in the circumferential direction, of the specific second gap g2S from the entire range in the circumferential direction. Then, after the welding at the specific portion, a portion whose position in the circumferential direction is the same as the position, in the circumferential direction, of the specific second gap, of the boundary between the metallic shell and the cap, is welded. Because of the above, when the welding at the specific portion is performed, degassing can be appropriately performed through the specific second gap. In addition, by performing welding over the entire circumference of the boundary between the metallic shell and the cap, the strength of joining can be enhanced.

The method for welding the cap to the metallic shell can be changed in accordance with the configurations of the cap and the metallic shell. For example, a gap may be provided in only a part of the range in the circumferential direction. In this case, welding may be performed at only the position in the circumferential direction at which the gap is provided, of the entire range in the circumferential direction. In either case, if the gap includes a first gap which communicates with the specific space and a second gap which communicates with the specific space and is larger than the first gap, after welding is performed at the same position in the circumferential direction as that of the first gap, welding is preferably performed at the same position in the circumferential direction as that of the second gap. By so doing, degassing can be appropriately performed through the second gap. Here, in order to appropriately perform degassing, the first gap further preferably communicates with the second gap. In addition, the method for manufacturing the spark plug is not limited to the method shown in FIG. 5, and other various methods can be used.

Figure 14:
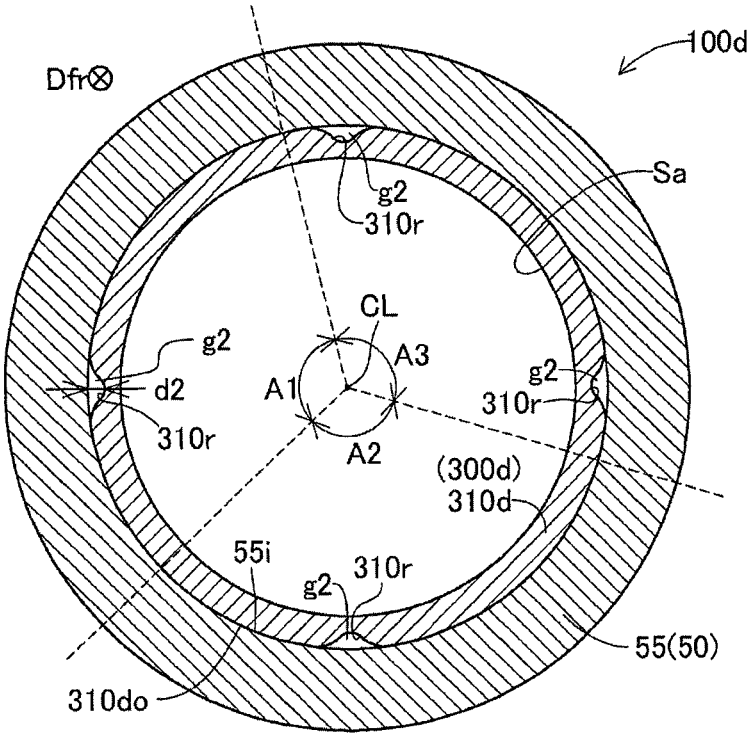
FIG. 14 is a cross-sectional view of a spark plug 100*d* of a modified embodiment.

(2) The outer diameter of the projection portion 310, 310*b*, or 310*c* may be equal to or larger than the inner diameter of the portion, at the front end direction Df side, of the metallic shell 50 or 50*c* (here, the trunk portion 55 or 55*c*). In this case, the size d1 of each first gap g1 is zero (i.e., each first gap g1 is omitted). FIG. 14 is a cross-sectional view of a spark plug 100*d* of a modified embodiment. In the drawing, the configuration in the same cross section as in FIG. 4 is shown. The difference from the spark plug 100 in FIG. 4 is only that the size d1 of each first gap g1 is zero, that is, each first gap g1 is omitted. Of an outer peripheral surface 310*do* of a projection portion 310*d* of a cap 300*d*, a portion other than recesses 310*r* is in close contact with the inner peripheral surface 55*i* of the metallic shell 50. The configuration of the other portion of the spark plug 100*d* is the same as that of the portion corresponding to the spark plug 100 (the same elements as the corresponding elements are designated by the same reference numerals, and the description thereof is omitted). In addition, the spark plug 100*d* can be manufactured by the manufacturing method in FIG. 5.

In step S142 in FIG. 5, the cap 300*d* can be placed at a specific position by press-fitting the projection portion 310*d* of the cap 300*d* into the through hole 59 through the opening OPf of the metallic shell 50. As shown in FIG. 14, a plurality of gaps g2 are provided at a plurality of positions in the circumferential direction when being seen from the direction of the axis CL (i.e., when being seen from a direction parallel to the axis CL). Before welding, each of the plurality of gaps g2 communicate with an annular gap gr formed by the chamfered portion 55*x* (FIG. 6(B)). In step S144 in FIG. 5, welding is performed by the same method as described with reference to FIG. 10. By so doing, gas within the gap gr can be exhausted out from the gap gr through the second gap g2 at an un-welded position in the circumferential direction. Therefore, occurrence of the voids 352 in the melt portion can be suppressed.

In addition, the gap which extends from the specific space to the melt portion may be provided in only a part of the range in the circumferential direction. For example, in each of the above-described embodiments, each first gap g1 may be provided only near the second gap g2 or g2*c*. In this case, a plurality of gaps which each include a first gap g1 and a second gap g2 or g2*c* and are separated from each other are located at a plurality of positions in the circumferential direction. Here, the second gap g2 or g2*c* may be omitted. In this case, a plurality of first gaps g1 which are separated from each other are located at a plurality of positions in the circumferential direction. As described above, regardless of the size of each gap, a plurality of gaps which are separated from each other may be located at a plurality of positions in the circumferential direction. Of the entire range in the circumferential direction, in a range where the size of the gap is zero (i.e., in a range where the gap is omitted), the cap and the metallic shell may not be welded, and in the range where the gaps are provided, the cap and the metallic shell may be welded. From the standpoint that desired joining strength between the cap and the metallic shell is ensured, the cap and the metallic shell are preferably welded over the entire range in the circumferential direction.

As the size of each gap, the maximum outer diameter of a sphere which can be disposed within the gap can be used. In addition, in order to achieve gas exhaust out through the first gap, the size of the first gap is preferably equal to or greater than 0.1 mm. In order to suppress misalignment of the cap relative to the metallic shell, the first gap is preferably equal to or less than 0.2 mm. However, the size of the first gap may be less than 0.1 mm or exceed 0.2 mm. In addition, the size of the second gap may be, for example, equal to or greater than 0.3 mm. In order to suppress an excessive increase in the size of the projection portion, the size of the second gap is preferably equal to or less than 1.0 mm. However, the size of the second gap may be less than 0.3 mm or exceed 1.0 mm.

(3) In each of the above-described embodiments, a part of the cap (here, the projection portion 310, 310*d*, 310*c*, or 310*d*) is located at the inner peripheral side of the melt portion 350 or 350*c* which joins the cap 300, 330*b*, 300*c*, or 300*d* and the metallic shell 50 or 50*c*. Therefore, scattering of a melted material into the specific space Sa or Sc at the time of welding can be suppressed. If the melted material scatters into the specific space Sa or Sc at the time of welding, the material that has scattered can be attached to the electrodes 20 and 30. As a result, discharge can occur along an unintended discharge path. In order to suppress such a problem, preferably, the cap includes, at the inner peripheral side of the inner peripheral surface of the metallic shell, a projection portion which projects to the rear end direction Dfr side, and the projection portion is located at the inner peripheral side of the melt portion. Instead of this, the metallic shell may include, at the inner peripheral side of the inner peripheral surface of the cap, a projection portion which projects to the front end direction Df side, and the projection portion may be located at the inner peripheral side of the melt portion. However, such a projection portion may be omitted.

(4) In each of the above-described embodiments, of the surface of the metallic shell 50 or 50*c*, the surface 55*i* or 55*ci* (referred to as "first surface") which forms the first gaps g1 and the second gaps g2 or g2*c* is parallel to the central axis CL. In addition, of the surface of the cap 300, 300*b*, 300*c*, or 300*d*, the surface 310*o*, 310*bo*, 310*co*, or 310*do* (referred to as "second surface") which forms the first gaps g1 and the second gaps g2 or g2*c* is parallel to the central axis CL. Therefore, by causing the second surface of the cap to face the first surface of the metallic shell, misalignment of the cap relative to the metallic shell (in particular, misalignment in the direction perpendicular to the central axis CL) can be suppressed.

In each of the above-described embodiments, the first surface is a portion, at the front side, of the inner peripheral surface 55*i* or 55*ci* of the metallic shell 50 or 50*c*. The projection portion 310, 310*b*, 310*c*, or 310*d* of the cap 300, 300*b*, 300*c*, or 300*d* projects toward the rear end direction Dfr and is located at the inner peripheral side of the first surface. The second surface is the outer peripheral surface 310*o*, 310*bo*, 310*co*, or 310*do* of the projection portion 310, 310*b*, 310*c*, or 310*d*. Therefore, By inserting the projection portion 310, 310*b*, 310*c*, or 310*d* into the through hole 59 of the metallic shell 50 or 50*c*, misalignment of the cap with respect to the metallic shell (in particular, misalignment in the direction perpendicular to the central axis CL) can be easily suppressed.

In general, the first surface of the metallic shell is preferably not perpendicular to the central axis CL. Here, among the angles formed between the normal of the first surface of the metallic shell and the central axis CL, the acute angle is preferably equal to or greater than 45 degrees, particularly preferably equal to or greater than 70 degrees, and most preferably 90 degrees (i.e., the first surface is parallel to the central axis CL).

Both the first surface and the second surface are preferably annular surfaces which extend around the central axis CL. According to this configuration, by disposing the cap with respect to the metallic shell such that the second surface faces the first surface, misalignment of the cap with respect to the metallic shell (in particular, misalignment in the direction perpendicular to the central axis CL) can be suppressed. However, at least one of the first surface and the second surface may be formed in only a part of the range in the circumferential direction.

(5) Of the surface of the metallic shell, the surface that forms the first gaps which communicate with the specific space surrounded by the metallic shell and the cap and the second gaps which communicate with the first gaps and the specific space and are larger than the first gaps, may be a portion of the metallic shell that is different from the inner peripheral surface thereof. Similarly, of the surface of the cap, the surface that forms the first gaps and the second gaps may be a portion of the cap that is different from the surface, at the outer peripheral side, of the projection portion. For example, the front end surface of the metallic shell and the rear end surface of the cap may form the first gaps and the second gaps.

(6) The gap which extends from the specific space surrounded by the metallic shell and the cap to the melt portion (the gap interposed between the metallic shell and the cap) is preferably an annular gap which extends around the central axis CL, like the above-described gaps g, gb, and gc. According to this configuration, degassing is possible from any position in the circumferential direction, and thus a possibility of occurrence of a problem due to welding can be reduced.

(7) The gap gr (i.e., the chamfered portion 55*x* (FIG. 6(A)) may be omitted. In this case, at the time of welding, gas present at the boundary between the cap and the metallic shell (e.g., between the end surfaces 55*f* and 300*r*) can be exhausted out via an un-welded boundary through the gap (e.g., the gaps g1 and g2) which communicates with the specific space (e.g., the specific space Sa). Even in the case where the gap gr (i.e., the chamfered portion 55*x*) is omitted as described above, at the time of welding, gas can be appropriately exhausted out through the gap which communicates with the specific space.

In order to make it easy to insert the projection portion (e.g., the projection portion 310 in FIG. 6(A)) of the cap into the through hole of the metallic shell, a chamfered portion is preferably formed in at least one of the metallic shell and the projection portion. For example, at a corner, at the outer peripheral side, of the end portion, at the rear end direction Dfr side, of the projection portion of the cap, a chamfered portion may be formed such that the outer diameter thereof gradually decreases toward the rear end direction Dfr.

(8) As the arrangement of the plurality of second gaps, other various arrangements can be used instead of the arrangements shown in FIGS. 4, 12, 13, and 14. For example, the plurality of second gaps may be arranged unequally along the circumferential direction. In general, an arrangement described below is preferably used. The metallic shell and the cap form N second gaps whose positions in the circumferential direction are different from each other, and N is an integer which is equal to or higher than 3. The N second gaps are projected parallel to the axis CL, onto a projection surface perpendicular to the axis CL. For example, the cross-sectional views in FIGS. 4, 12, 13, and 14 correspond to the above projection surface. Then, the projection surface is divided into three regions each having a center angle of 120 degrees centered at the axis CL. In each of the drawings, three regions A1, A2, and A3 each having a center angle of 120 degrees centered at the axis CL are shown. The plurality of second gaps are preferably arranged such that each of the three regions includes one or more of the second gaps. In each of the embodiments in FIGS. 4, 12, 13, and 14, each of the regions A1, A2, and A3 includes one or more of the second gaps g2 or g2*c*. When the N second gaps g2 are arranged so as to be dispersed in the three regions A1, A2, and A3 each having a center angle of 120 degrees as described above, uneven arrangement of the N second gaps g2 in the circumferential direction can be suppressed. Therefore, for example, a problem that appropriate degassing cannot be performed in the case of welding at a specific position in the circumferential direction (e.g., a position distant from any second gap g2) can be suppressed.

The number of the second gaps included in each of the three regions A1, A2, and A3 can be changed by changing the positions, in the circumferential direction, of the three regions A1, A2, and A3. For example, in the embodiments in FIGS. 4, 12, 13, and 14, when boundary lines between the three regions A1, A2, and A3 are rotated clockwise, the number of the second gaps g2 or g2*c* in each of the regions A1, A2, and A3 changes. In general, the N second gaps may be arranged so as to allow the projection surface to be divided into three regions each having a center angle of 120 degrees centered at the axis CL such that each of the three regions include one or more of the second gaps.

Although the arrangement of the second gaps has been described above, in the case where a plurality of gaps separated from each other regardless of the sizes of the gaps are arranged at a plurality of positions in the circumferential direction, the plurality of gaps are preferably arranged so as to be dispersed in the three regions A1, A2, and A3, similarly to the above arrangement of the second gaps.

(9) The configuration of the spark plug including the cap and the metallic shell is not limited to the configuration of each of the embodiments and modified embodiments described above, and various configurations which allow degassing to be performed at the time of welding can be used. In general, a configuration described below is preferably used. The spark plug includes: a metallic shell having a through hole extending in the direction of the axis; a cap covering an opening, at the front side, of the metallic shell; and a melt portion formed between the cap and the metallic shell to join the cap and the metallic shell to each other. The spark plug includes a gap extending from a specific space which is a space surrounded by the metallic shell and the cap to the melt portion and interposed between the metallic shell and the cap. When such a configuration is used, degassing is possible through the gap at the time of formation of the melt portion (at the time of welding), and thus occurrence of a problem due to welding can be suppressed.

In the spark plug, as the configuration of the portion other than the joined portion of the cap and the metallic shell, any configuration can be used. For example, the tip 200 of the center electrode 20 may be omitted. In this case, the leg portion 25 preferably includes a portion corresponding to the tip 200. In addition, a tip formed by using a material having excellent durability against discharge may be provided at the portion, forming the discharge gap sg, of each ground electrode 30. Moreover, the configurations of the center electrode and each ground electrode (e.g., the configuration of the portion forming the discharge gap sg) is not limited to the configuration in FIGS. 2 and 3, and any other configuration can be used.

Although the present invention has been described above based on the embodiments and the modified embodiments, the above-described embodiments of the invention are intended to facilitate understanding of the present invention, not as the present invention. The present invention can be changed and modified without departing from the gist thereof and the scope of the claims and equivalents thereof are encompassed in present invention.

DESCRIPTION OF REFERENCE NUMERALS

5: gasket
6: first rear packing
7: second rear packing
8: front packing
9: talc
10: insulator (ceramic insulator)
11: second reduced outer diameter portion
12: through hole (axial bore)
13: leg portion
15: first reduced outer diameter portion
16: reduced inner diameter portion
17: front trunk portion
18: rear trunk portion
19: flange portion
20: center electrode
21: outer layer
22: core portion
23: head portion
24: flange portion
25: leg portion
27: axial portion
30: ground electrode
40: metal terminal
50, 50*c*: metallic shell
51: tool engagement portion
52: thread
53: crimp portion
54: seat portion
55, 55*c*: trunk portion
55*f*: end surface
55*i*, 55*ci*: inner peripheral surface
55*r*: recess
55*x*: chamfered portion
56: reduced inner diameter portion
58: deformable portion
59: through hole
60: first seal portion
70: resistor
80: second seal portion
100, 100*b*, 100*c*: spark plug
200: tip
200*s*: side surface
310, 310*b*, 310*c*, 310*z*: projection portion
300, 300*b*, 300*c*, 300*z*: cap
300*i*: inner surface
300*r*: end surface
310*o*, 310*bo*, 310*co*: outer peripheral surface
310*r*: recess
350, 354: melt portion
350*m*, 354*m*: melted portion
352: void
390: hole
sg: discharge gap
g, gb, gc, gr, gx: gap
g1: first gap
g2, g2*c*: second gap
g2S: specific second gap
A1, A2, A3: region
CL: central axis (axis)
GS: gas
Sa, Sc: specific space
Df: front end direction
Dfr: rear end direction
Di: inward direction
Do: outward direction
Lz: laser beam
Lz1: first position
Lz2: second position
OPf: opening

The invention claimed is:

1. A spark plug comprising:

a metallic shell having a through hole extending in a direction of an axis and having an opening at an open end;

a cap that is located at a front side of the spark plug and covers the opening in the metallic shell; and a melt portion provided between the cap and the metallic shell, said melt portion joining the cap and the metallic shell to each other, wherein the cap and the metallic shell form a specific space surrounded by an inner surface of the cap and the inner peripheral surface of the metallic shell, the cap has a projection that extends from the peripheral edge of the cap into the specific space so as to form a gap between the metallic shell and the projection of the cap defining a channel communicating with the specific space and the melt portion, and the melt portion is exposed to the specific space so as to exhaust gas generated by welding into the gap.

2. The spark plug according to claim 1, wherein the gap includes:

a first gap portion disposed between the interior surface of the metallic shell and the projection of the cap; and a second gap portion disposed between the interior surface of the metallic shell and a recess in the projection of the cap, wherein the second gap portion is larger than the first gap portion in at least one dimension.

3. The spark plug according to claim 2, wherein the metallic shell has a first surface which is not perpendicular to the axis, and the cap has a second surface which faces the first surface of the metallic shell to provide the first gap and the second gap.

4. The spark plug according to claim 1, wherein the gap is annular.

5. The spark plug according to claim 1, wherein the gap is provided at a plurality of positions in a circumferential direction when being seen from the direction of the axis.

6. A method for manufacturing a spark plug, the method comprising the steps of:

placing a cap on a metallic shell that has a through hole extending in a direction of an axis and has an opening at an open end thereof, said cap having an inner surface and a projecting portion extending from an inner peripheral edge of the cap so as to form an annular gap between the projection and the inner surface of the shell, the cap and the metallic shell forming a specific space surrounded by an inner surface of the cap and the inner peripheral surface of the metallic shell; and welding the cap to the shell so that the projection of the cap extends into the open end of the metallic shell volume, such that the gap defines a channel between the specific space and a melt portion formed by the welding, wherein the melt portion is exposed to the specific space so as to exhaust gas generated by welding into the gap, the annular gap includes:

a first gap portion which communicates between the melt portion and the specific space; and a second gap portion which communicates between the specific space and the melt portion at the location of recesses in the cap projection, wherein because of the recesses the second gap is larger than the first gap, and the step of welding the cap to the metallic shell further comprises the sub-steps of:

welding a specific portion whose position in a circumferential direction is different from that of a specific second gap, of a boundary between the cap and the metallic shell which communicates with the annular gap; and after welding the specific portion, welding a portion whose position in the circumferential direction is the same as that of the specific second gap, of the boundary.

7. The spark plug according to claim 1, wherein the cap has at least one communication hole which provides communication between the specific space and an outside of the cap.

* * * * *